US009661898B2

(12) United States Patent
Miner

(10) Patent No.: US 9,661,898 B2
(45) Date of Patent: May 30, 2017

(54) SOLE STRUCTURE WITH VISUAL EFFECTS

(71) Applicant: NIKE, Inc., Beaverton, OR (US)

(72) Inventor: Mark C. Miner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 396 days.

(21) Appl. No.: 14/178,354

(22) Filed: Feb. 12, 2014

(65) Prior Publication Data

US 2014/0223672 A1 Aug. 14, 2014

Related U.S. Application Data

(62) Division of application No. 12/860,173, filed on Aug. 20, 2010, now Pat. No. 8,689,467.

(51) Int. Cl.

| | |
|---|---|
| ***A43B 1/00*** | (2006.01) |
| ***A43B 3/00*** | (2006.01) |
| ***A43B 13/12*** | (2006.01) |
| ***A43B 13/14*** | (2006.01) |
| ***A43D 8/00*** | (2006.01) |
| ***A43B 13/18*** | (2006.01) |

(52) U.S. Cl.

CPC ..... *A43D 8/00* (2013.01); *A43B 1/0027* (2013.01); *A43B 3/0052* (2013.01); *A43B 13/125* (2013.01); *A43B 13/141* (2013.01); *A43B 13/181* (2013.01)

(58) Field of Classification Search

CPC ... A43B 1/0027; A43B 3/0052; A43B 13/125; A43B 13/127; A43B 13/141; A43B 13/16; A43B 13/42; A43B 13/181; A43D 8/00

USPC ..... 36/25 R, 28, 29, 30 A, 31, 103

See application file for complete search history.

(56) References Cited

U.S. PATENT DOCUMENTS

| | | | | |
|---|---|---|---|---|
| 3,720,971 | A * | 3/1973 | Wyness | A43D 8/006 12/146 C |
| 4,183,156 | A | 1/1980 | Rudy | |
| 4,219,945 | A | 9/1980 | Rudy | |
| D261,325 | S | 10/1981 | Niro | |
| 4,309,831 | A | 1/1982 | Pritt | |
| D275,148 | S | 8/1984 | Bergmans | |
| 4,578,882 | A | 4/1986 | Talarico, II | |
| D294,421 | S | 3/1988 | Le | |
| D294,653 | S | 3/1988 | Le | |
| 4,936,029 | A | 6/1990 | Rudy | |

(Continued)

FOREIGN PATENT DOCUMENTS

| | | |
|---|---|---|
| CH | 698 210 B1 | 6/2009 |
| CN | 1817261 A | 8/2006 |

(Continued)

OTHER PUBLICATIONS

Response filed Mar. 9, 2015 in Chinese Patent Application No. 201180050554.7.

(Continued)

*Primary Examiner* — Sharon M Prange

(74) *Attorney, Agent, or Firm* — Banner & Witcoff, Ltd.

(57) ABSTRACT

A multi-colored effect for a sole structure for an article of footwear is disclosed. The sole structure comprises a sole member having a first color and an exterior layer having a second color that is different from the sole member. A plurality of slots are formed in the sole structure and the second color is visible on an outer surface of the sole structure through the plurality of slots.

17 Claims, 10 Drawing Sheets

(56) References Cited

U.S. PATENT DOCUMENTS

| | | | | |
|---|---|---|---|---|
| 5,042,176 | A | 8/1991 | Rudy | |
| D322,881 | S | 1/1992 | Bushman | |
| 5,191,727 | A | 3/1993 | Barry et al. | |
| 5,713,141 | A | 2/1998 | Mitchell et al. | |
| 5,797,199 | A | 8/1998 | Miller et al. | |
| 5,952,065 | A | 9/1999 | Mitchell et al. | |
| 6,009,637 | A | 1/2000 | Pavone | |
| 6,013,340 | A | 1/2000 | Bonk et al. | |
| 6,023,859 | A | 2/2000 | Burke et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| D474,580 | S | 5/2003 | Pollastrelli | |
| D475,508 | S | 6/2003 | Pollastrelli | |
| 6,931,764 | B2 | 8/2005 | Swigart et al. | |
| 6,966,128 | B2 | 11/2005 | McClaskie | |
| 6,976,320 | B2 | 12/2005 | McClaskie | |
| 7,013,581 | B2 * | 3/2006 | Greene | A43B 7/08 36/114 |
| 7,096,603 | B2 | 8/2006 | Fusco | |
| 7,290,357 | B2 | 11/2007 | McDonald et al. | |
| 7,350,320 | B2 | 4/2008 | Chandler et al. | |
| 7,401,418 | B2 | 7/2008 | Wyszynski et al. | |
| 7,401,419 | B2 | 7/2008 | Lucas et al. | |
| D574,582 | S | 8/2008 | Della Valle | |
| D577,179 | S | 9/2008 | Della Valle | |
| D577,181 | S | 9/2008 | Della Valle | |
| 7,467,484 | B2 * | 12/2008 | Chang | A43B 7/1445 36/103 |
| 7,562,469 | B2 | 7/2009 | Dojan | |
| 7,637,033 | B2 | 12/2009 | Sokolowski et al. | |
| 7,704,430 | B2 | 4/2010 | Johnson et al. | |
| 7,731,883 | B2 | 6/2010 | Johnson et al. | |
| 8,001,703 | B2 | 8/2011 | Schindler et al. | |
| 8,151,485 | B2 | 4/2012 | Hurd et al. | |
| 8,387,279 | B2 | 3/2013 | Pauk et al. | |
| 8,424,225 | B2 * | 4/2013 | Hazenberg | A43B 13/122 36/102 |
| 8,661,717 | B2 | 3/2014 | Miner | |
| 8,689,467 | B2 | 4/2014 | Miner | |
| 8,732,986 | B2 | 5/2014 | Miner | |
| 2004/0024645 | A1 | 2/2004 | Potter et al. | |
| 2005/0071242 | A1 | 3/2005 | Allen et al. | |
| 2006/0117604 | A1 | 6/2006 | Fusco | |
| 2006/0201028 | A1 | 9/2006 | Chan et al. | |
| 2006/0288612 | A1 | 12/2006 | Lucas et al. | |
| 2007/0039204 | A1 | 2/2007 | Wyszynski et al. | |
| 2007/0199211 | A1 | 8/2007 | Campbell | |
| 2007/0199213 | A1 | 8/2007 | Campbell et al. | |
| 2008/0022553 | A1 | 1/2008 | McDonald et al. | |
| 2008/0184595 | A1 | 8/2008 | Schindler et al. | |
| 2008/0216355 | A1 | 9/2008 | Becker et al. | |
| 2008/0244926 | A1 | 10/2008 | Yu et al. | |
| 2008/0289224 | A1 | 11/2008 | Sink | |
| 2009/0071040 | A1 | 3/2009 | Fergus | |
| 2009/0178303 | A1 | 7/2009 | Hurd et al. | |
| 2010/0083535 | A1 | 4/2010 | Meschter et al. | |
| 2010/0154257 | A1 | 6/2010 | Bosomworth et al. | |
| 2010/0269271 | A1 | 10/2010 | Kim et al. | |
| 2012/0042539 | A1 | 2/2012 | Miner | |
| 2012/0042540 | A1 | 2/2012 | Miner | |
| 2012/0042541 | A1 | 2/2012 | Miner | |
| 2014/0189965 | A1 | 7/2014 | Miner | |
| 2014/0289977 | A1 | 10/2014 | Miner | |
| 2014/0290094 | A1 | 10/2014 | Miner | |

FOREIGN PATENT DOCUMENTS

| | | | |
|---|---|---|---|
| CN | 103179873 | A | 6/2013 |
| CN | 103200832 | A | 7/2013 |
| CN | 103200833 | A | 7/2013 |
| DE | 10 2005 006 267 | B3 | 3/2006 |
| EP | 1 787 540 | A1 | 5/2007 |
| EP | 1 857 004 | A1 | 11/2007 |
| EP | 2 198 729 | A1 | 6/2010 |
| EP | 2 277 402 | A2 | 1/2011 |
| EP | 2 732 717 | A1 | 5/2014 |
| WO | 2009/091451 | A1 | 7/2009 |
| WO | 2012/024456 | A1 | 2/2012 |
| WO | 2012/024457 | A1 | 2/2012 |
| WO | 2012/024458 | A1 | 2/2012 |

OTHER PUBLICATIONS

European Search Report dated Apr. 11, 2014 in European Patent Application No. 13197582.3.

Office Action mailed Sep. 30, 2015 in Chinese Patent Application No. 201180050502.X, and the English translation thereof.

International Search Report and Written Opinion mailed Dec. 22, 2011 in PCT/US2011/048165.

International Preliminary Report on Patentability (including Written Opinion of the ISA) mailed Mar. 7, 2013 in International Application No. PCT/US2011/048163.

International Preliminary Report on Patentability (including Written Opinion of the ISA) mailed Mar. 7, 2013 in International Application No. PCT/US2011/048164.

International Preliminary Report on Patentability (including Written Opinion of the ISA) mailed Mar. 7, 2013 in International Application No. PCT/US2011/048165.

Office Action mailed Mar. 20, 2013 in U.S. Appl. No. 12/860,153.

International Search Report and Written Opinion mailed Dec. 1, 2011 in PCT/US2011/048164.

Office Action mailed Feb. 28, 2013 in U.S. Appl. No. 12/860,173.

International Search Report and Written Opinion mailed Dec. 22, 2011 in PCT/US2011/048163.

Second Office Action mailed Jul. 3, 2015 for Chinese Application No. CN201180050502.X filed Aug. 18, 2011.

English Translation of Response filed Apr. 7, 2015 in Chinese Patent Application No. CN201180050502.X.

Office Action issued Dec. 1, 2014 in Chinese Patent Application No. 201180050502.X.

Office Action issued Oct. 24, 2014 in Chinese Patent Application No. 201180050554.7.

Voluntary Amendments filed Sep. 18, 2013 in European Patent Application No. 11749669.5.

Voluntary Amendments filed Sep. 18, 2013 in European Patent Application No. 11770209.2.

Voluntary Amendments filed Sep. 20, 2013 in European Patent Application No. 11770210.0.

* cited by examiner

SOLE STRUCTURE WITH VISUAL EFFECTS

CROSS REFERENCE TO RELATED APPLICATION

This application is a division of U.S. patent application Ser. No. 12/860,173, filed Aug. 20, 2010 (published as U.S. Patent Application Publication Number 2012/0042540 on Feb. 23, 2012), which is incorporated by reference in its entirety.

BACKGROUND

The present invention relates generally to an article of footwear, and in particular to an article of footwear with grooves and a method of making the article.

Another commonly owned application to Miner, U.S. patent publication number 2012/0042541, filed Aug. 20, 2010 (published Feb. 23, 2012), entitled "Article of Footwear with Slots and Method of Making," hereby referred to as "the slotted sole case," is incorporated by reference in its entirety. In addition, another commonly owned application to Miner, U.S. patent publication number 2012/0042539, filed Aug. 20, 2010 (published Feb. 23, 2012), entitled "Sole Structure Comprising a Fluid Filled Member with Slots," is also incorporated by reference in its entirety.

Articles of footwear with slots or grooves are known. Meschter et al. (U.S. patent application publication number 2010/0083535), the entirety of which is incorporated by reference, teaches an article of footwear having an upper decoupled from the sole in a midfoot region. Shaffer teaches lateral and medial recesses that are cut into the side of the sole in the longitudinal direction.

Fergus (U.S. patent application publication number 2009/0071040) teaches a felt sole with improved traction. The felt sole has integral downwardly extending protrusions located over the bottom surface of the felt sole. Fergus teaches that methods for creating the traction pattern can include cutting or laser burning the pattern into one surface of the flat felt sheet.

Campbell (U.S. patent application publication number 2007/0199211) teaches a flexible foot-support structure. Campbell teaches a shoe with an outsole that includes at least two recessed segments extending in a longitudinal direction in the forefoot portion. Campbell teaches that the recessed segments can be provided in the sole structure in any desired manner, such as during a sole member molding process, by a cutting action (e.g. using knives, lasers, etc.), and/or any other manner.

McClaskie (U.S. Pat. No. 6,976,320) teaches a sandal or shoe having an outsole with a sock lining on top of and in direct contact with the outsole for directly contacting a user's foot and a cushion having a thickness between approximately ⅛ and 1½ inches, where the cushion is placed between the outsole and the sock lining. McClaskie teaches a notch, which is any recess, indentation, relief, channel groove, or etching in the side surface of the outsole sufficient to provide clearance for the securing mechanism. McClaskie further teaches that the notch can be formed using machining, molding, grinding, etching or laser cutting.

The related art lacks provisions for enhancing stability, flexibility and fit simultaneously in a sole structure. There is a need for articles that address the limitations of the related art.

SUMMARY

In one aspect, the invention provides an article of footwear, comprising: a sole structure including a side portion, a lower portion and a lower periphery disposed between the side portion and the lower portion; a first slot disposed in the side portion and a second slot disposed in the lower portion; a connecting portion extending to the lower periphery, the connecting portion separating the first slot from the second slot; an outer surface of the side portion having a first color and the connecting portion having a second color that is different from the first color; and wherein a portion of the connecting portion is visible through the first slot.

In another aspect, the invention provides an article of footwear, comprising: a sole structure comprising a lateral side portion, a medial side portion and a lower portion; the sole structure further comprising a first portion and a second portion, the first portion and the second portion having an approximately rectangular cross-sectional shape; a hollowed out portion disposed between the first portion and the second portion, the hollowed out portion comprising a first slot disposed on the lateral side portion, a second slot disposed on the medial side portion and a third slot disposed on the lower portion; the hollowed out portion further comprising a connecting member that extends between the first portion and the second portion; the connecting member having a first color and the lateral side portion, the medial side portion and the lower portion having a second color that is different from the first color; and wherein the first color is visible through the first slot, the second slot and the third slot.

In another aspect, the invention provides an article of footwear, comprising: a sole structure including a side portion, a lower portion and a lower periphery disposed between the side portion and the lower portion; the sole structure comprising a midsole having a first color; an insert disposed within a cavity of the midsole, the insert having a second color that is different from the first color; a first slot disposed on the side portion of the sole structure, the first slot extending through the midsole and a portion of the insert; a second slot disposed on the lower portion of the sole structure, the second slot extending through the midsole and a portion of the insert; a connecting portion of the sole structure extending to the lower periphery and separating the first slot from the second slot; and wherein a portion of the insert is visible through the first slot.

In another aspect, the invention provides a method of making an article of footwear, comprising the steps of: forming a cavity in a midsole of a first color; placing an insert of a second color into the cavity; forming a plurality of slots through the midsole and the insert; and wherein the second color is visible through the slots.

In another aspect, the invention provides a method of making an article of footwear, comprising the steps of: applying a lower portion of an upper onto a sidewall of a midsole; the lower portion of the upper having a first color and the midsole having a second color; forming a plurality of slots in the lower portion and the sidewall; and wherein the second color is visible through the slots.

In another aspect, the invention provides a method of making an article of footwear, comprising the steps of: applying a tread assembly having a first color to a midsole having a second color; forming a plurality of slots in the tread assembly and the midsole; and wherein the second color is visible through the slots.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
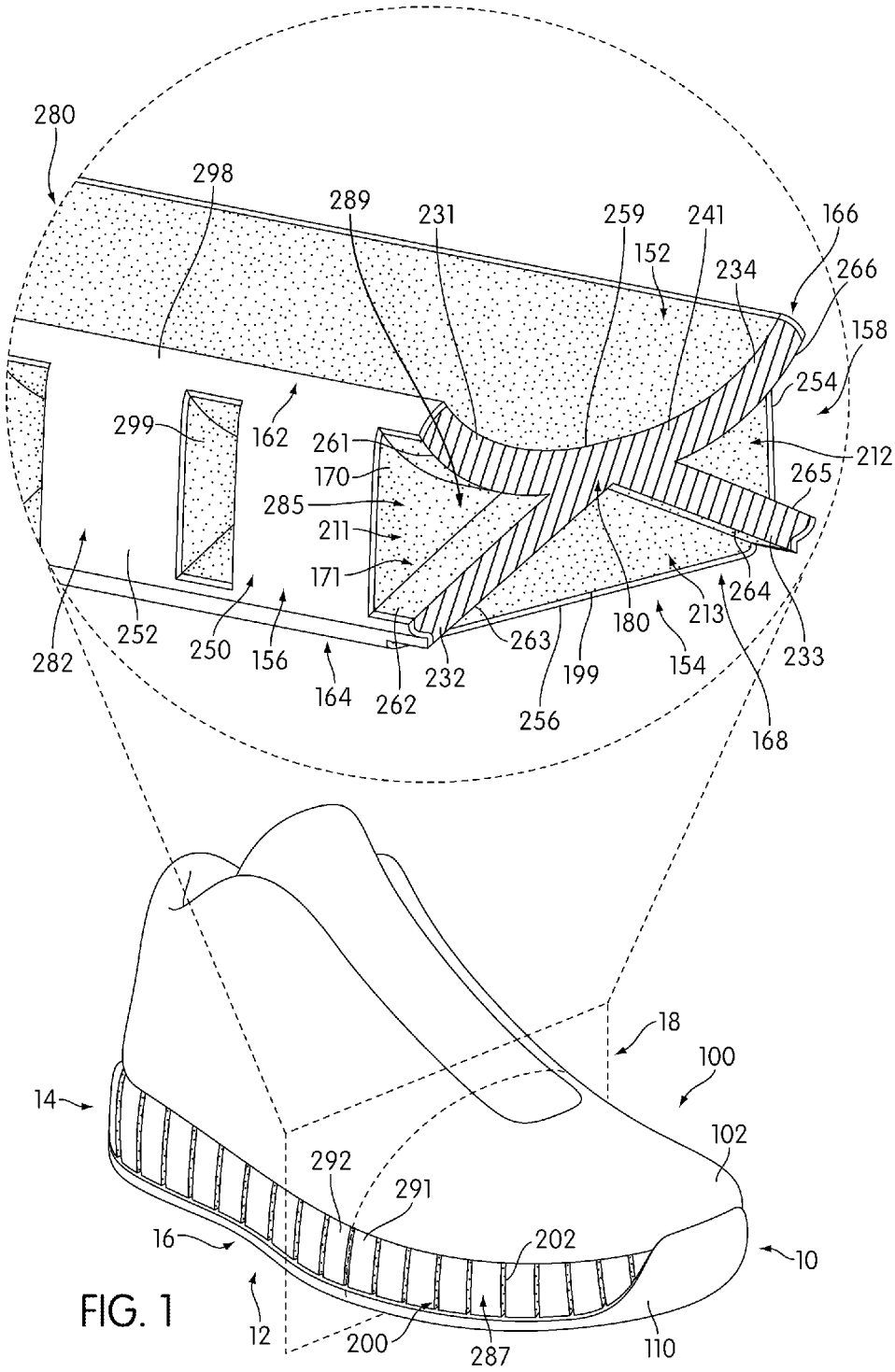
FIG. 1 is a lateral isometric view of an embodiment of an article of footwear with a plurality of slots.
Figure 2:
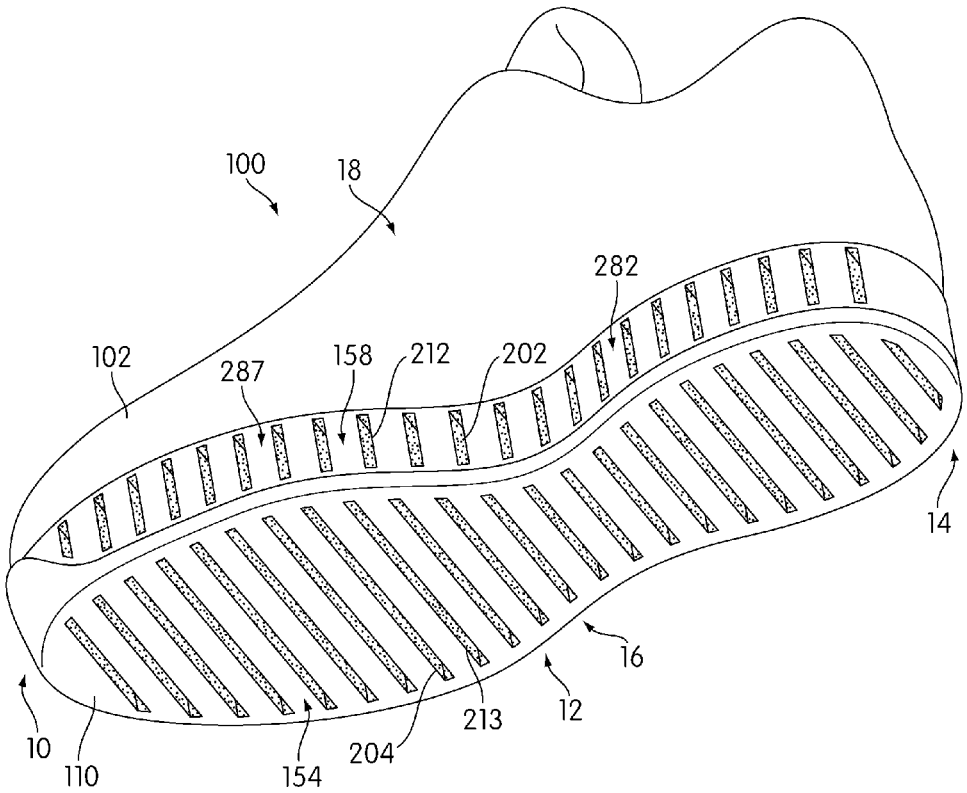
FIG. 2 is a medial isometric view of an embodiment of an article of footwear with a plurality of slots.

FIGS. 1 and 2 illustrate views of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 1 and 2, article of footwear 100, also referred to simply as article 100, is intended to be used with a right foot; however, it should be understood that the following discussion may equally apply to a mirror image of article of footwear 100 that is intended for use with a left foot.

Referring to FIGS. 1 and 2, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Sole structure 110 can include upper portion 152 and lower portion 154 disposed opposite of upper portion 152. In some cases, upper portion 152 can be disposed adjacent to upper 102. In addition, in some cases, lower portion 154 can be a ground contacting surface. Sole structure 110 can further include lateral side portion 156 and medial side portion 158. Lateral side portion 156 may extend between upper portion 152 and lower portion 154 on lateral side 16 of sole structure 110. Likewise, medial side portion 158 may extend between upper portion 152 and lower portion 154 on medial side 18 of sole structure 110.

In some embodiments, sole structure 110 can include lateral upper periphery 162 disposed between lateral side portion 156 and upper portion 152. Also, sole structure 110 can include lateral lower periphery 164 disposed between lateral side portion 156 and lower portion 154. Furthermore, sole structure 110 can include medial upper periphery 166 disposed between medial side portion 158 and upper portion 152. Also, sole structure 110 can include medial lower periphery 168 disposed between medial side portion 158 and lower portion 154.

A sole structure can include provisions for increasing flexibility, fit and stability for an article of footwear. In some embodiments, a sole structure can be provided with one or more slots. In some cases, slots can be provided on a side portion of the sole structure. In other cases, slots can be provided on a lower portion of the sole structure. In one embodiment, slots can be provided on side portions of the sole structure as well as on lower portions of the sole structure.

In one embodiment, sole structure 110 can include plurality of slots 200. Generally, plurality of slots 200 can comprise various slots arranged in a variety of orientations and in a variety of locations on sole structure 110. For example, in some embodiments, plurality of slots 200 may include first slot set 202 that extends in a generally vertical direction on lateral side portion 156 and medial side portion 158. Furthermore, plurality of slots 200 may also include second slot set 204 that comprises slots arranged in a generally lateral direction on lower portion 154 of sole structure 110.

Additionally, in some cases, plurality of slots 200 could include one or more longitudinal slots arranged on lateral side portion 156 and/or medial side portion 158. Also, plurality of slots 200 could include one or more longitudinal slots arranged on lower portion 154. For purposes of clarity, the current embodiment is shown without any longitudinal slots. Examples of embodiments including longitudinal slots may be found in the slotted sole case.

In different embodiments, the number of slots comprising plurality of slots 200 can vary. For example, in one embodiment, first slot set 202 can comprise between 1 and 100 slots. In another embodiment, first slot set 202 can comprise between 40 and 70 slots. In still other embodiments, first slot set 202 can include more than 100 slots. In addition, in some embodiments, second slot set 204 can include between 1 and 30 slots. In other embodiments, second slot set 204 can include more than 30 slots. Still further, while plurality of slots 200 comprises four longitudinal slots disposed on medial side portion 158 and lateral side portion 156, in other embodiments, plurality of slots 200 could comprise additional longitudinal slots. In still other embodiments, plurality of slots 200 may not include any longitudinal slots on lateral side portion 156 or medial side portion 158. In still other embodiments, plurality of slots 200 may comprise between 1 and 3 longitudinal slots on lateral side portion 156 and/or medial side portion 158.

In some embodiments, first slot set 202 may not extend through medial lower periphery 168. Likewise, in some cases, first slot set 202 may not extend through lateral lower periphery 164. Additionally, in some embodiments, second slot set 204 may not extend through medial lower periphery 168. Also, second slot set 204 may not extend through lateral lower periphery 164. In other words, medial lower periphery 168 and lateral lower periphery 164 may be boundaries for first slot set 202 and second slot set 204.

Generally, the arrangement of one or more slots on a sole structure can vary. In some cases, one or more slots may have a linear configuration or shape. In other cases, one or more slots may have a nonlinear configuration or shape. It will be understood that the term "nonlinear configuration" is not intended to be limited to a particular type of nonlinear shape or arrangement. For example, a nonlinear configuration for one or more slots can include smooth nonlinear shapes such as sinusoidal shapes, wavy shapes, as well as other smooth nonlinear shapes. Also, a nonlinear configuration for one or more slots can include polygonal nonlinear shapes with edges such as zig-zag shapes, triangle wave shapes, square wave shapes, as well as any other types of non-smooth nonlinear shapes. Furthermore, in some cases, one or more slots can be associated with a regular nonlinear configuration that includes repeating patterns. In other cases, however, one or more slots can be associated with an irregular nonlinear configuration that does not include repeating patterns. In still other cases, one or more slots can be associated with a nonlinear configuration that includes some portions with repeating patterns and other portions with non-repeating patterns.

In the exemplary embodiment, first slot set 202 may include slots that have a slightly curved shape. In other cases, first slot set 202 may include slots that have a substantially linear shape. Furthermore, in some cases, second slot set 204 may include slots with substantially curved shapes. For example, some slots of second slot set 204 may have arc-like shapes. In some cases, the amount of arcing can decrease as the distance of each slot from midfoot portion 12 increases. In other embodiments, however, any other linear or nonlinear configurations for first slot set 202 and/or second slot set 204 are possible. In addition, in different embodiments, any type of linear or nonlinear configuration can be used for various longitudinal slots provided on a sole structure.

In different embodiments, the dimensions of one or more slots of first slot set 202 can vary. In some embodiments, the heights of each slot in first slot set 202 in the generally vertical direction can vary. For example, in one embodiment, slots of first slot set 202 disposed in forefoot portion 10 may be shorter than slots of first slot set 202 disposed in heel portion 14. In other cases, however, the heights of each slot in first slot set 202 can vary in another manner.

Additionally, the widths of each slot in first slot set 202, which may be measured along a generally longitudinal direction, can vary. In some cases, each slot in first slot set 202 can have a substantially similar width. In other cases, two or more slots in first slot set 202 can have substantially different widths.

In some embodiments, the lengths of slots in second slot set 204, as measured in a generally lateral direction on lower portion 154, can vary. In some cases, each slot can have a substantially similar length. In other cases, however, the length of each slot can vary with the width of sole structure 110. For example, in the current embodiment, each slot of second slot set 204 may have a length that is proportional to the width of sole structure 110 in the region associated with the slot.

In some embodiments, the widths of slots in second slot set 204, as measured in a generally longitudinal direction on lower portion 154, can vary. In some cases, each slot can have a substantially similar width. In other cases, however, the width of each slot in second slot set 204 can vary. Furthermore, in some embodiments, the widths of each slot may vary along the length of the slot. For example, in the current embodiment, the widths of each slot in second slot set 204 may be larger towards the center portions of each slot, and narrower at the end portions of each slot. In other embodiments, however, the widths of each slot in second slot set 204 can vary in other manners.

In some embodiments, the lengths of one or more longitudinal slots can vary. In some cases, the length of each longitudinal slot can extend along a substantial length of a sole structure. In other cases, the lengths of each longitudinal slot can be substantially shorter than the length of the sole structure. In addition, each longitudinal slot can have widths that vary. Furthermore, in some cases, the depths of each longitudinal slot can vary.

In some embodiments, slots on different portions of a sole structure can be generally aligned with one another with respect to the longitudinal direction. For example, in some cases, slots on the side portions of a sole structure may be generally aligned with slots on the lower portion of the sole structure. In other words, these slots may be associated with approximately similar longitudinal positions. In other embodiments, however, slots on the side portions may not be aligned with slots on the lower portion. Furthermore, it will be understood that in some embodiments, only some slots may be generally aligned on side portions and lower portions of the sole structure, while other slots may not be aligned.

In some embodiments, one or more slots from first slot set 202 may correspond to one or more slots from second slot set 204. In some cases, some slots of first slot set 202 may be approximately aligned with some slots from second slot set 204. It will be understood that the approximate alignment between some slots refers to an approximately similar location for these slots along the longitudinal direction of article 100. For example, in the current embodiment, first slot 211 and second slot 212, disposed on lateral side portion 156 and medial side portion 158, respectively, may be approximately aligned with third slot 213, which is disposed on lower portion 154.

In a similar manner, other slots of first slot set 202 may be approximately aligned with slots of second slot set 204. In other embodiments, however, slots of first slot set 202 may not be aligned with slots of second slot set 204. In addition, in some cases, only some slots of first slot set 202 and second slot set 204 may be aligned. In particular, in embodiments where there is a greater number of slots on medial side portion 158 than the number of slots of second slot set 204, it may not be possible to align all of the slots of first slot set 202 located on medial side portion 158 with each of the slots of second slot set 204. Similarly, in embodiments where there is a greater number of slots on lateral side portion 156 than the number of slots of second slot set 204, it may not be possible to align all of the slots of first slot set 202 located on lateral side portion 156 with each of the slots of second slot set 204.

In some embodiments, slots can provide means for decoupling portions of a sole in order to enhance fit, flexibility and stability for an article of footwear. For example, in some cases, slots can be applied to side portions and lower portions of a sole structure to reduce the cross sectional profile of the sole structure at particular regions and to facilitate increased flexibility between various portions of the sole structure. In an exemplary embodiment, slots can be applied to side portions and lower portions to form connecting portions between adjacent portions of the sole structure that articulate with respect to one another.

In the current embodiment, first slot 211, second slot 212 and third slot 213 each extend from outer surface 250 of sole structure 110 towards central portion 180 of sole structure 110. For example, first slot 211 extends from outer lateral surface 252 of lateral side portion 156 to central portion 180. Similarly, second slot 212 extends from outer medial surface 254 of medial side portion 158 to central portion 180. Furthermore, third slot 213 extends from outer lower surface 256 of lower portion 154 to central portion 180.

In some embodiments, first slot 211, second slot 212 and third slot 213 may be further associated with one or more connecting portions. The term "connecting portion" as used throughout this detailed description and in the claims, refers to a portion of a sole structure that helps to join adjacent portions of a sole structure that are partially separated by one or more slots in a substantially longitudinal direction. In some cases, two or more connecting portions that are joined together can comprise a connecting member. In an exemplary embodiment, first slot 211, second slot 212 and third slot 213 may be associated with first connecting portion 231, second connecting portion 232, third connecting portion 233 and fourth connecting portion 234.

In some cases, first connecting portion 231 may be a portion of sole structure 110 that bounds a portion of first slot 211. In particular, first connecting portion 231 may bound an upper portion of first slot 211. In some cases, first connecting portion 231 may extend from central portion 180 to lateral upper periphery 162 of sole structure 110. Furthermore, first connecting portion 231 may have an upper surface that corresponds to upper surface 259 of upper portion 152. First connecting portion 231 may also include first inner surface 261 that is associated with an inner surface of first slot 211.

In some embodiments, second connecting portion 232 may be a portion of sole structure 110 that is disposed between first slot 211 and third slot 213. In other words, second connecting portion 232 may bound portions of both first slot 211 and third slot 213. In some cases, second connecting portion 232 may extend from central portion 180 to lateral lower periphery 164. In addition, second connecting portion 232 can include second inner surface 262 that is associated with an inner surface of first slot 211. Also, second connecting portion 232 can include third inner surface 263 that is associated with an inner surface of third slot 213.

In some embodiments, third connecting portion 233 may be a portion of sole structure 110 that is disposed between second slot 212 and third slot 213. In other words, third connecting portion 233 may bound portions of both second slot 212 and third slot 213. In some cases, third connecting portion 233 may extend from central portion 180 to medial lower periphery 168. In addition, third connecting portion 233 can include fourth inner surface 264 that is associated with an inner surface of third slot 213. Also, third connecting portion 233 can include fifth inner surface 265 that is associated with an inner surface of second slot 212.

In some embodiments, fourth connecting portion 234 may be a portion of sole structure 110 that bounds a portion of second slot 212. In particular, fourth connecting portion 234 may bound an upper portion of second slot 212. In some cases, fourth connecting portion 234 may extend from central portion 180 to medial upper periphery 166. Furthermore, fourth connecting portion 234 may have an upper surface that corresponds to upper surface 259 of upper portion 152. Fourth connecting portion 234 may also include sixth inner surface 266 that is associated with an inner surface of second slot 212.

Using this arrangement, first connecting portion 231, second connecting portion 232, third connecting portion 233 and fourth connecting portion 234 can comprise first connecting member 241 that extends within hollowed out portion 289 that is formed by first slot 211, second slot 212 and third slot 213. In some cases, first connecting member 241 may help connect first sole portion 291 and second sole portion 292, which are partially separated by first slot 211, second slot 212 and third slot 213. In other words, first connecting member 241 may help prevent first sole portion 291 and second sole portion 292 from being completely decoupled.

In some embodiments, other slots of plurality of slots 200 can be aligned in similar manners to form additional hollowed out portions for sole structure 110. These slots can be further associated with connecting members that provide connecting material between adjacent sections of sole structure 110. For example, in some embodiments, first connecting member 241 may be configured to provide connecting material between first sole portion 291 and second sole portion 292. Likewise, sole structure 110 can include additional hollowed out portions that are formed by slots aligned along side portions and a lower portion of sole structure 110 that form a connected core for sole structure 110. This arrangement allows for some decoupling between adjacent portions in a generally longitudinal direction and can increase the flexibility of sole structure 110, providing enhanced flexibility for a user of article 100. Also, in some cases, this arrangement can increase the flexibility between upper and lower portions of the sole structure, especially at the lateral and medial sides. In addition, the partially decoupled portions of sole structure 110 can better conform to the shape of a foot to enhance fit. Still further, the partially decoupled portions can move somewhat independently to adjust to changes in position of article 100, which allows for enhanced stability for a user.

In different embodiments, the geometry of one or more slots can vary. For example, in the current embodiment, first slot 211, second slot 212 and third slot 213 have triangular or wedge-like geometries. In other embodiments, however, first slot 211, second slot 212 and third slot 213 could have any other geometries. Additionally, the geometry of one or more connecting portions could also be varied. Examples of various possible geometries for slots and/or connecting portions are discussed in detail in the slotted sole case.

By varying the geometries of each slot, including the depths, the flexibility and rigidity of the associated connecting portions can be fine tuned. For example, in the exemplary embodiment, the wedge or triangular shapes of each slot helps to form connecting portions that may easily flex or bend away from one another to allow the upper portion of the sole structure to partially decouple from the lower portion of the sole structure. In particular, in some cases, first connecting portion 231 can be configured to move somewhat independently of second connecting portion 232, which helps to partially decouple lateral upper periphery 162 from lateral lower periphery 164. Likewise, third connecting portion 233 can be configured to move somewhat independently of fourth connecting portion 234, which helps to partially decouple medial upper periphery 166 from medial lower periphery 168. With this arrangement, lower portion 154 of sole structure 110 can remain planted on a ground surface while upper portion 152, which supports a foot, can move somewhat independently to increase overall flexibility, fit and stability.

An article of footwear can provide various visual effects on a sole structure. In embodiments comprising a plurality of slots, an outer portion of a sole structure may be configured with a different color than an interior portion, which may be visible through the slots. For example, in one embodiment, a sole structure may have a first color on an outer portion and a second color on an interior portion. With this arrangement, the second color of the interior portion may be visible through the slots to provide a multi-colored effect for the sole structure.

In some embodiments, a sole structure could comprise two distinct components having different visual properties. In the current embodiment, sole structure 110 may comprise sole member 280 and exterior layer 282. In some cases, sole member 280 may be a midsole. In other cases, sole member 280 could be any other component of a sole structure including, but not limited to: an insole and/or an outsole. Sole member 280 may comprise a majority of sole structure 110 and may provide a majority of the structural properties of sole structure 110. In contrast, exterior layer 282 may be a substantially thin layer that covers outer surface 199 of sole member 280.

In some embodiments, exterior layer 282 may have first color 298 and sole member 280 may have second color 299. In some cases, first color 298 may be substantially similar to second color 299. In other cases, first color 298 may be substantially different from second color 299. For example, in one embodiment, sole member 280 may have a substantially blue color, while exterior layer 282 may have a substantially white color. It will be understood that these colors are only intended as examples and in other embodiments sole member 280 and exterior layer 282 could have any other colors or combination of colors.

Referring to FIGS. 1 and 2, second color 299 of sole member 280 may be visible through plurality of slots 200. For example, in the current embodiment, interior surface 170 of first slot 211 has second color 299. In particular, sidewall surfaces 171 of first slot 211 have second color 299. Similarly, first inner surface 261 of first connecting portion 231 and second inner surface 262 of second connecting portion 232 have second color 299. Moreover, since portions of sidewall surfaces 171, first inner surface 261 and second inner surface 262 are visible through opening 285 of first slot 211, second color 299 may be seen through first slot 211. Similarly, portions of second connecting portion 232 and third connecting portion 233 may be visible through third slot 213. Also, third connecting portion 233 and fourth connecting portion 234 may be visible through second slot 212. Furthermore, the interior surfaces of each of the remaining slots of plurality of slots 200 may also be visible through the openings of plurality of slots 200 on lateral side portion 156, medial side portion 158 and lower portion 154 of sole structure 110. In contrast, the regions between adjacent slots, which comprise regions of exterior layer 282, have first color 298. With this arrangement, outer surface 287 of sole structure 110 may be provided with a substantially unique visual appearance comprising a surface of a first color interrupted by regions of a second color corresponding to the locations of plurality of slots 200.

In the current embodiment, the regions comprising second color 299 can be varied by varying the shapes of one or more slot openings. Although the current embodiment comprises substantially rectangular slot openings, in other embodiments the shapes of slot openings on any portion of a sole structure could be varied. Examples of other shapes that could be used for the slot openings include, but are not limited to: rounded shapes, rectangular shapes, square shapes, polygonal shapes, regular shapes, irregular shapes as well as any other kinds of shapes.

In some embodiments, the appearance of second color 299 through a slot opening can be enhanced by the sloped interior surfaces of each slot. For example, as discussed above, interior surface 170 of first slot 211 comprises first inner surface 261 of first connecting portion 231 and second inner surface 262 of second connecting portion 232 that are generally sloped surfaces. In particular, first inner surface 261 slopes downwardly from lateral upper periphery 162 to central portion 180. Likewise, second inner surface 262 slopes upwardly from lateral lower periphery 164 to central portion 180. This allows more of interior surface 170 to be visible through first slot 211, especially when viewed from various angles, which can enhance the visual effect provided on sole structure 110. In a similar manner, each of the remaining slots of plurality of slots 200 comprise sloped interior surfaces associated with corresponding connecting portions that increase the visibility of second color 299 through plurality of slots 200.

In different embodiments, exterior layer 282 could be any type of layer that is applied to sole member 280. In some cases, exterior layer 282 could be a layer of paint that is applied to sole member 280. In other embodiments, exterior layer 282 could be a colored film that is applied to sole member 280. In still other embodiments, exterior layer 282 could comprise a thin layer of a polymer material, such as thermoplastic polyurethane (TPU). In another embodiment, exterior layer 282 could be a layer of ink that is printed directly onto sole member 280. In still other embodiments, exterior layer 282 may be any layer that can be configured with an opaque color or design.

It will be understood that a plurality of slots could be formed in any manner on a sole structure. Examples of methods for forming slots are disclosed in the slotted sole case. In embodiments where slots may be applied to a sole structure after an exterior layer has been applied to a sole member, this arrangement allows for an efficient method of providing a distinct visual appearance on a sole without requiring the application of many different paints to color internal surfaces of a plurality of slots, which can be time consuming and cost intensive. Instead, the step of removing material from the sole structure automatically creates the distinct visual appearance by allowing the color of the sole member to be visible through slot openings formed on the outer surface of the sole structure.

Although the current embodiment uses two distinct colors, in other embodiments more than two colors could be used. In some cases, a sole member or an exterior layer could be associated with two or more colors. As an example, in another embodiment, the forefoot portion of a sole member may comprise a first color and the heel portion could comprise a second color. Then, by applying an exterior layer having a third color over the sole member and forming slots in the sole structure, both the first color and the second color may be visible with the third color on an outer surface of the sole structure. It will also be understood that other embodiments are not limited to the use of solid colors and may incorporate various colorful designs, graphics or any other combination of colors.

A multi-colored effect for a sole structure could be accomplished in various ways. FIGS. 3 through 7 are intended to illustrate additional embodiments of a multi-colored sole system. It will be understood throughout the remainder of this detailed description that each of the sole structures discussed below may be provided with a plurality of slots in a substantially similar arrangement to the plurality of slots discussed for the first embodiment. In particular, each embodiment comprises a sole structure including slots that are arranged to form hollowed out portions that provide increased flexibility for adjacent portions of a sole structure.

Figure 3:
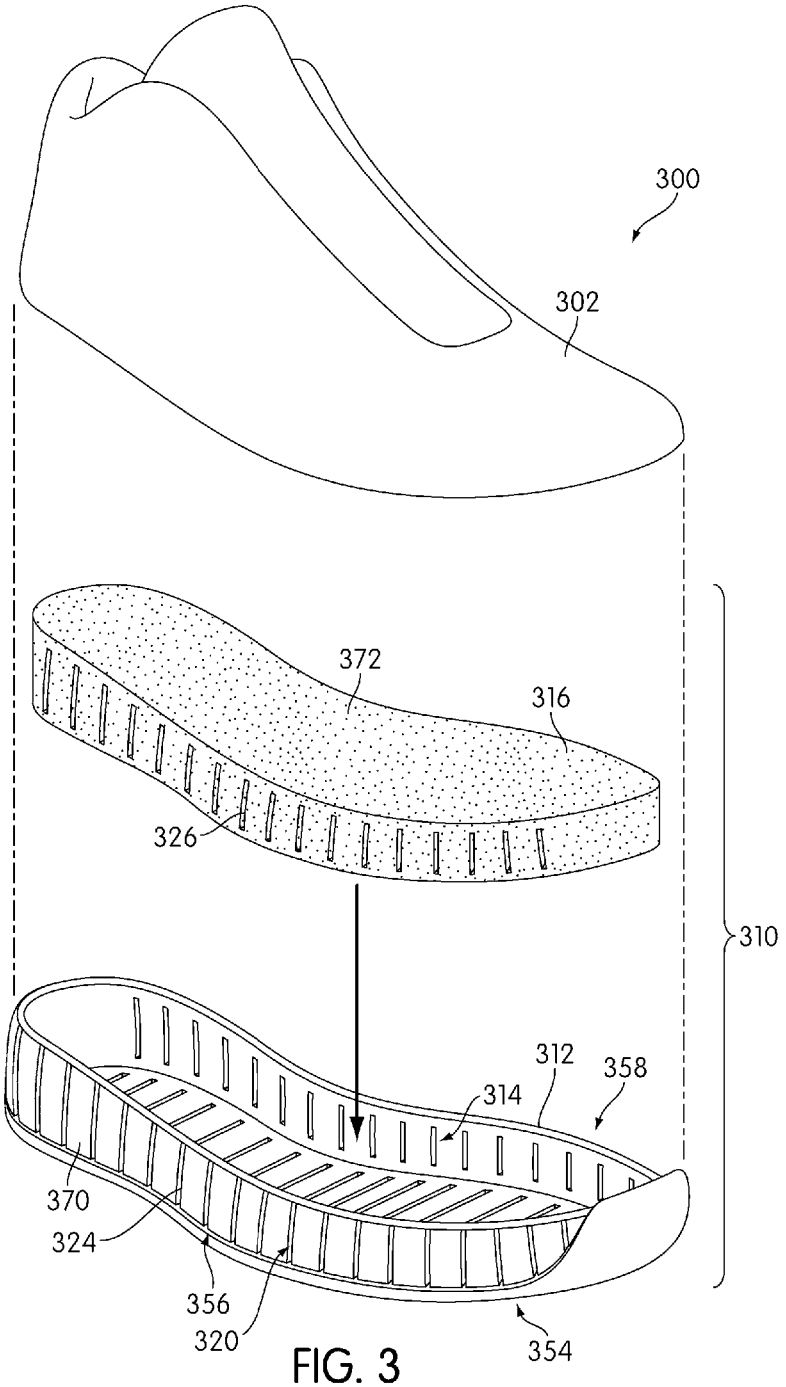
FIG. 3 is an exploded isometric view of an embodiment of an article of footwear with a plurality of slots.
Figure 4:
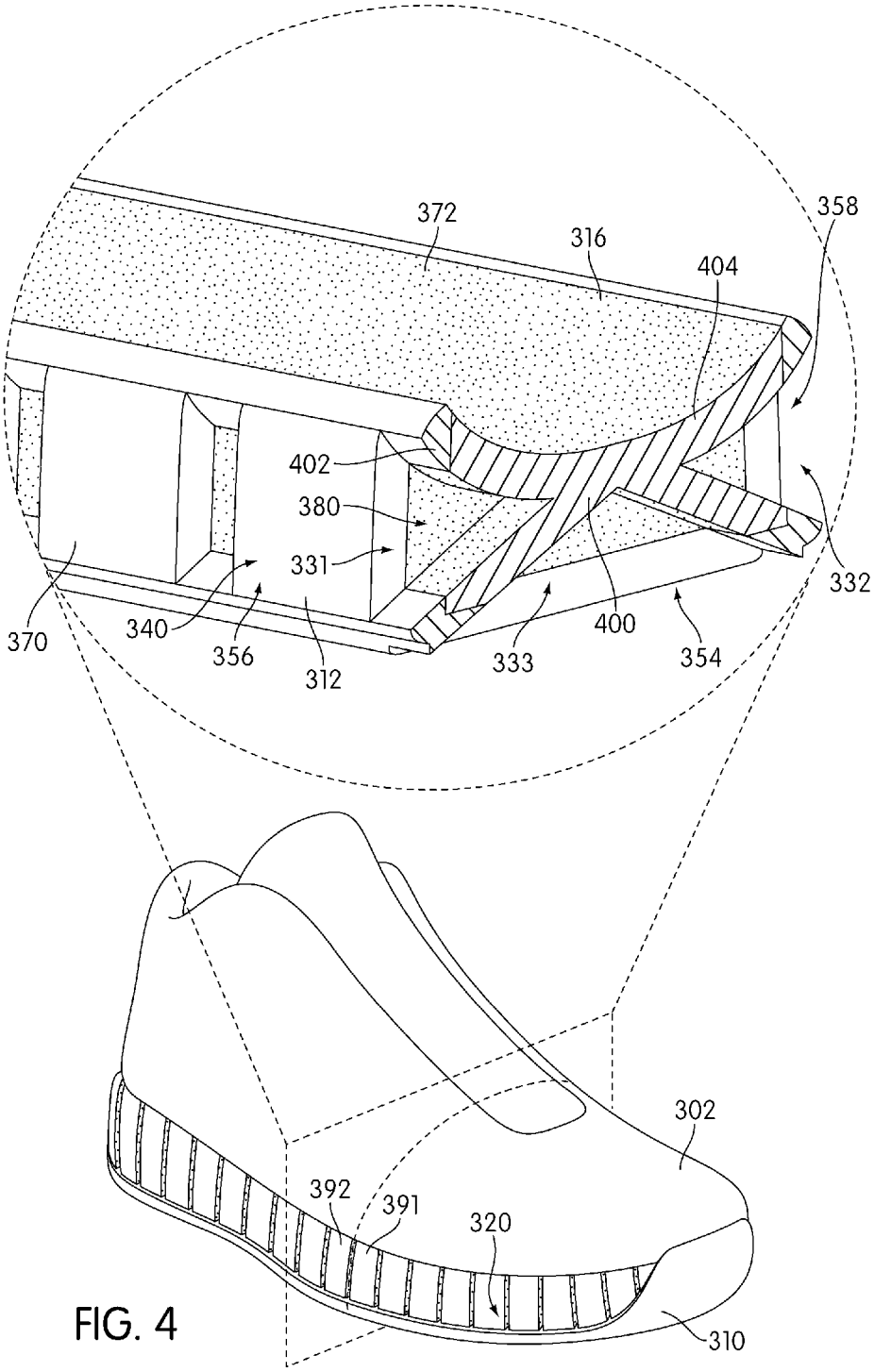
FIG. 4 is an isometric view of an embodiment of an article of footwear with a plurality of slots.

Referring to FIGS. 3 and 4, article 300 may comprise upper 302 and sole structure 310. In some cases, sole structure 310 may further comprise midsole 312. Midsole 312 may comprise a semi-rigid structure that extends throughout a substantial entirety of sole structure 310. Midsole 312 may also include interior cavity 314.

In some embodiments, sole structure 310 may also comprise insert 316 that is configured to insert into interior cavity 314 of midsole 312. Generally, insert 316 could be any type of insert known in the art. For example, in some cases, insert 316 could be an air bladder to provide additional cushioning for sole structure 310. In other cases, insert 316 could be a foam insert. In still other cases, any other kind of insert can be used.

Sole structure 310 may be provided with plurality of slots 320. In one embodiment, the arrangement of plurality of slots 320 on sole structure 310 may be substantially similar to the arrangement of plurality of slots 200 discussed in the previous embodiment. In addition, plurality of slots 320 may extend through both midsole 312 as well as insert 316. For example, plurality of slots 320 may comprise slots that are disposed on lateral side portion 356, medial side portion 358, and lower portion 354 of sole structure 310. Plurality of slots 320 may comprise outer portions 324 on midsole 312 and inner portions 326 on insert 316. For example, in the current embodiment, first slot 331 extends through both midsole 312 and insert 316. Similarly, second slot 332 extends through both midsole 312 and insert 316. Additionally, third slot 333 extends through both midsole 312 and insert 316. By providing slots that extend into both midsole 312 and insert 316, portions of insert 316 may be visible through plurality of slots 320 on outer surface 340 of sole structure 310.

First slot 331, second slot 332 and third slot 333 may form hollowed out portion 380. In some cases, hollowed out portion 380 can include connecting member 400 that extends between first portion 391 and second portion 392 of sole structure 310. In the current embodiment, end portions 402 of connecting member 400 may be formed from midsole 312. In addition, intermediate portion 404 of connecting member 400 that extends between end portions 402 may be formed from insert 316. Although connecting member 400 has an x-like cross-sectional shape in the current embodiment, in other embodiments connecting member 400 could have any other cross-sectional shape. Examples of different cross-sectional shapes are discussed in the slotted sole case.

In some embodiments, midsole 312 may have first color 370. In addition, insert 316 may have second color 372. In some cases, first color 370 could be substantially similar to second color 372. In other embodiments, first color 370 could be substantially different from second color 372. In an exemplary embodiment, first color 370 could be substantially different from second color 372. For example, in one embodiment, first color 370 could be a white color and second color 372 could be a red color. It will be understood that in different embodiments any two distinct colors could be used.

In this embodiment, different portions of connecting member 400 have different colors. In particular, end portions 402 have first color 370, since end portions 402 are formed from midsole 312. In addition, intermediate portion 404 has second color 372, since intermediate portion 404 is formed from insert 316. In other embodiments, however, a connecting member could comprise a single color or pattern.

As illustrated in FIG. 4, intermediate portion 404 of connecting member 400 is visible through first slot 331, second slot 332 and third slot 333. Moreover, since intermediate portion 404 of connecting member 400 comprises second color 372, second color 372 may be visible through first slot 311, second slot 312 and third slot 313. In other words, this arrangement provides a multi-colored effect on outer surface 340 of sole structure 310.

In a similar manner, second color 372 may be visible through each of the remaining slots of plurality of slots 320. In particular, each of the slots of plurality of slots 320 may form hollowed out portions comprising connecting members that are visible through the slots. This arrangement helps to provide a multi-colored effect for sole structure 310 that can enhance the visual appearance of article 300. Moreover, in some cases where interchangeable inserts are used, different types of inserts can be associated with different colors in order to allow a user to easily identify the current insert by viewing the color appearing through the slots.

Figure 5:
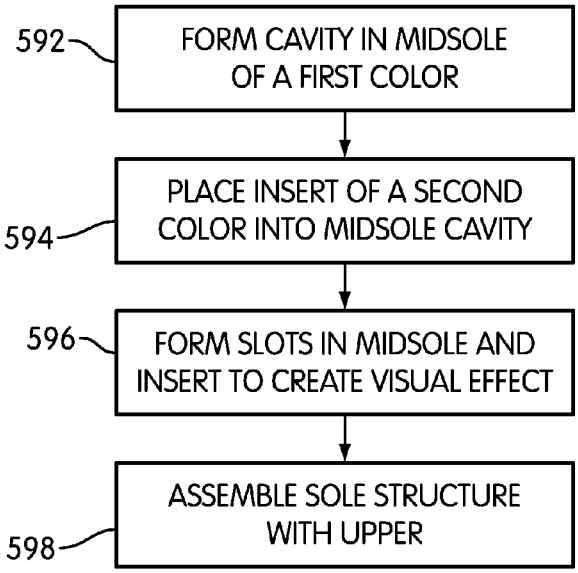
FIG. 5 is an embodiment of a process of making an article of footwear with a plurality of slots.

FIG. 5 illustrates an embodiment of a process for making an article of footwear. In this embodiment, the following steps may be performed by any proprietor configured to manufacture and/or sell an article of footwear. A proprietor may include one or more factories, multiple offices, retailers and various other establishments associated with a business. Generally, the term "proprietor," as used here, may also refer to distributors and/or suppliers. In other words, the term proprietor may also apply to various operations on the manufacturing side, including the operations responsible for parts, labor, and/or retail of the article of footwear, as well as other manufacturing side operations. In addition, it will be understood that in other embodiments one or more of the following steps may be optional.

During step 592, a cavity may be formed in a midsole of a first color. In some cases, the cavity may have a shape that generally corresponds to the shape of an insert. Next, during step 594, an insert of a second color which is different than the first color can be inserted into the cavity of the midsole. Following this, during step 596, slots can be formed in the midsole and in the insert. In an exemplary embodiment, the slots can be formed in any of the arrangements discussed above. For example, in one embodiment, slots can be formed in a manner that forms hollowed out portions of the sole structure having substantially x-like cross sectional shapes. In particular, slots can be formed through the midsole and the insert that are substantially aligned in the longitudinal direction in the manner discussed in the previous embodiments. In other embodiments, however, the slots can be provided in any other configuration. Once the slots are formed, the second color of the insert may be generally visible through the slots on an outer surface of the sole structure, as discussed above. Finally, during step 598, the sole structure can be assembled with an upper.

Although the current embodiment of a process discusses placing an insert into a midsole cavity before the slots are formed, in other cases the slots could be formed on the midsole and the insert separately and then joined to form the sole structure. In other words, the steps of forming slots and the steps of placing an insert into a midsole can be performed in any order.

Figure 6:
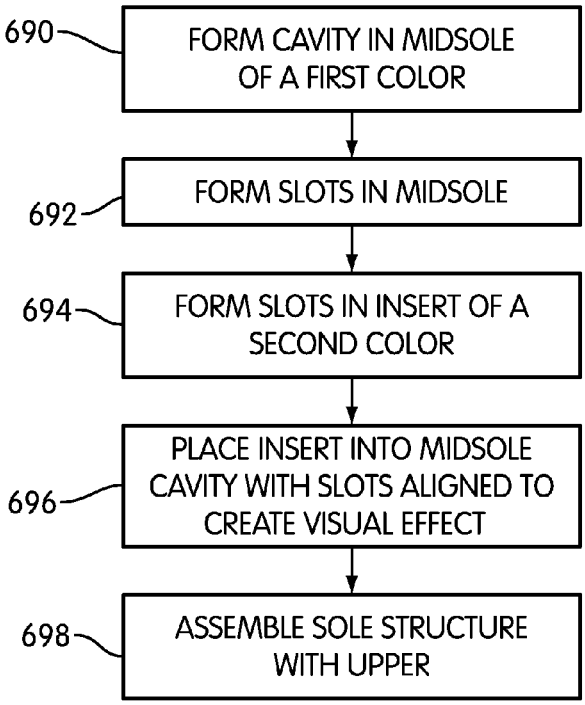
FIG. 6 is an embodiment of a process of making an article of footwear with a plurality of slots.

FIG. 6 illustrates an embodiment of an alternative process for making an article of footwear in which the step of forming slots in the midsole and the insert is performed before the insert is placed into the midsole. Referring to FIG. 6, during step 690, a cavity may be formed in a midsole of a first color. In some cases, the cavity may have a shape that generally corresponds to the shape of an insert.

Next, during step 692, a first plurality of slots may be formed in the midsole. Following step 692, during step 694, a second plurality of slots can be formed in an insert of a second color that is different from the first color. In some cases, the second plurality of slots may correspond to the first plurality of slots. Next, during step 696, the insert may be placed into the midsole cavity with the first plurality of slots of the midsole and the second plurality of slots of the insert aligned to create a visual effect for the sole structure. Finally, during step 610, the sole structure can be assembled with an upper.

In an exemplary embodiment, the first plurality of slots and the second plurality of slots can be formed in any of the arrangements discussed above. For example, in one embodiment, the first plurality of slots and the second plurality of slots can be formed in a manner that forms hollowed out portions of the sole structure having substantially x-shaped cross sectional shapes. In particular, slots can be formed through the midsole and the insert that are substantially aligned in the longitudinal direction in the manner discussed in the previous embodiments. In other embodiments, however, the slots can be provided in any other configuration.

Generally, any known methods for forming slots in a midsole, an insert and/or the combination of a midsole and an insert can be used. In some cases, a midsole can be molded in a manner that creates slots. Likewise, in some cases, an insert can be molded in a manner that creates slots. In other cases, however, slots can be created by cutting. For example, in one embodiment, slots can be created using laser cutting techniques. Specifically, in some cases, a laser can be used to remove material from a midsole and/or an insert in a manner that forms slots. In another embodiment, a hot knife process could be used for forming slots. Examples of methods for forming slots are disclosed in U.S. Patent Application Publication Number 2008/0022553, to McDonald, the entirety of which is hereby incorporated by reference. Other examples of methods that could be used for forming slots are disclosed in U.S. Ser. No. 12/428,501, filed on Apr. 23, 2009, the entirety of which is hereby incorporated by reference. In other embodiments, however, any other type of cutting method can be used for forming slots. Furthermore, in some cases, two or more different techniques can be used for forming slots. Still further, different types of techniques could be used according to the material used for components of a sole structure. For example, laser cutting may be used for forming slots in an insert while a molding process can be used to form slots in a midsole.

Figure 7:
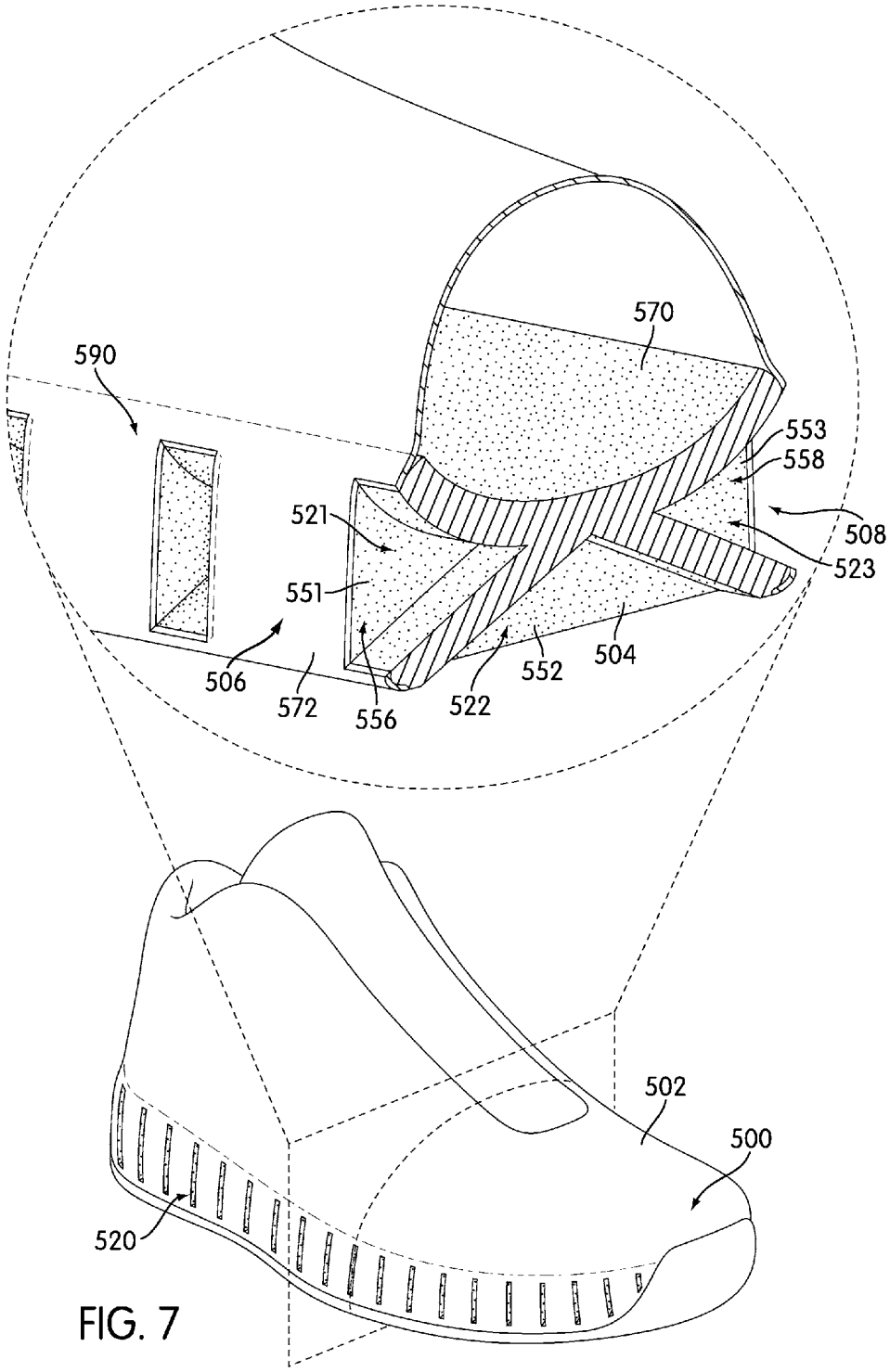
FIG. 7 is an isometric view of an embodiment of an article of footwear with a plurality of slots.

An article can include provisions for creating visual effects on the lower portions of a double lasted upper. Referring to FIG. 7, article 500 comprises upper 502 and midsole 504. In this case, upper 502 is a double lasted upper that extends over lateral side portion 556 and medial side portion 558 of midsole 504. In this case, article 500 further comprises plurality of slots 520 that are disposed on lateral side portion 556 and medial side portion 558 of midsole 504. Furthermore, plurality of slots 520 extend through portions of upper 502 disposed against lateral side portion 556 and medial side portion 558. Specifically, plurality of slots 520 may extend through lower lateral portion 506 and lower medial portion 508 of upper 502 that generally overlap with lateral side portion 556 and medial side portion 558 of midsole 504.

In some embodiments, midsole 504 and upper 502 can be provided with different colors. In the current embodiment, midsole 504 has first color 570 and upper 502 has second color 572. In an exemplary embodiment, first color 570 is substantially different from second color 572. For example, in one embodiment, first color 570 could be blue and second color 572 could be white. In other embodiments, however, any other colors could be used.

In the current embodiment, first color 570 may be visible through plurality of slots 520. For example, in the current embodiment, first interior surface 551 of first slot 521, second interior surface 552 of second slot 522 and third interior surface 553 of third slot 523 may be visible on outer surface 590 of upper 502. In a similar manner, each of the remaining slots of plurality of slots 520 have interior surfaces of first color 570 that may be visible on outer surface 590. With this arrangement, a multi-colored effect is created for the double lasted arrangement of article 500.

Figure 8:
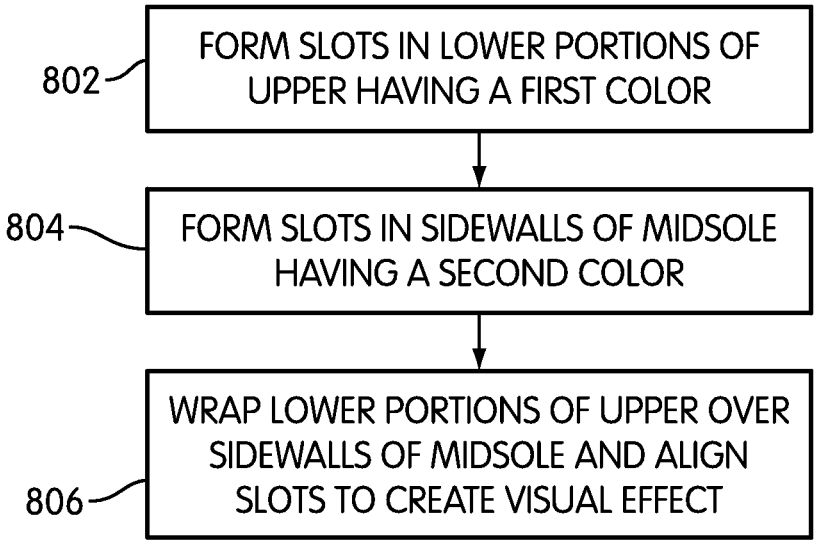
FIG. 8 is an embodiment of a process of making an article of footwear with a plurality of slots.

FIG. 8 illustrates an embodiment of a process for making an article of footwear. In this embodiment, the following steps may be performed by any proprietor configured to manufacture and/or sell an article of footwear. In addition, it will be understood that in other embodiments one or more of the following steps may be optional.

During step 802, a first plurality of slots may be formed in the lower portions of an upper having a first color. Next, during step 804, a second plurality of slots can be formed in the sidewalls of a midsole having a second color. It will be understood that any known methods for forming slots in an upper and/or a midsole can be used, including any of the methods discussed above. Furthermore, in some cases, the slots can be formed in any of the arrangements discussed above. For example, in one embodiment, the slots can be formed in a manner that provides hollowed out portions of a sole structure having substantially x-shaped cross sectional shapes. In particular, slots can be formed through the midsole and the upper that are substantially aligned in the longitudinal direction in the manner discussed in the previous embodiments. In other cases, however, the slots can have any other configuration. Finally, during step 806, the lower portions of the upper may be wrapped around the sidewalls of the midsole so that the first plurality of slots of the lower portions and the second plurality of slots of the midsole are aligned. At this point, the lower portions of the upper can be attached to the sidewalls of the midsole in any manner. It will be understood that the lower portions of the upper can be joined to the sidewalls of the midsole using any known methods. In some cases, the lower portions can be attached to the sidewalls of the midsole using an adhesive of some kind. In other cases, the lower portions can be attached by stitching. In still other cases, any other methods known in the art can be used.

It will be understood that the order of the steps performed above could vary in different embodiments. For example, in another embodiment, the steps of forming slots in the upper and the midsole could be performed after the lower portions of the upper have been attached to the sidewalls of the midsole. In other words, the slots could be formed simultaneously through the lower portions of the upper and the sidewalls of the midsole.

Figure 9:
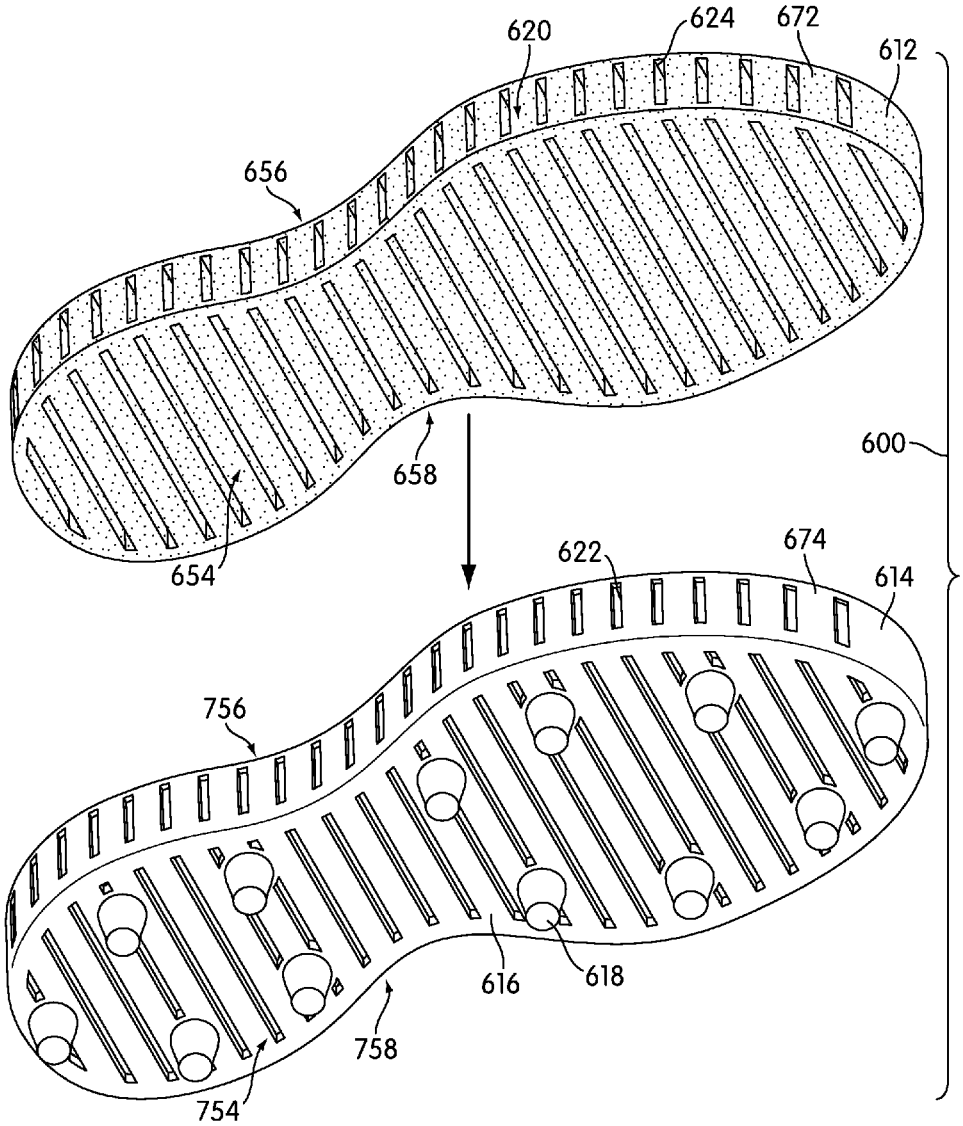
FIG. 9 is an exploded isometric view of an embodiment of an article of footwear with a plurality of slots.
Figure 10:
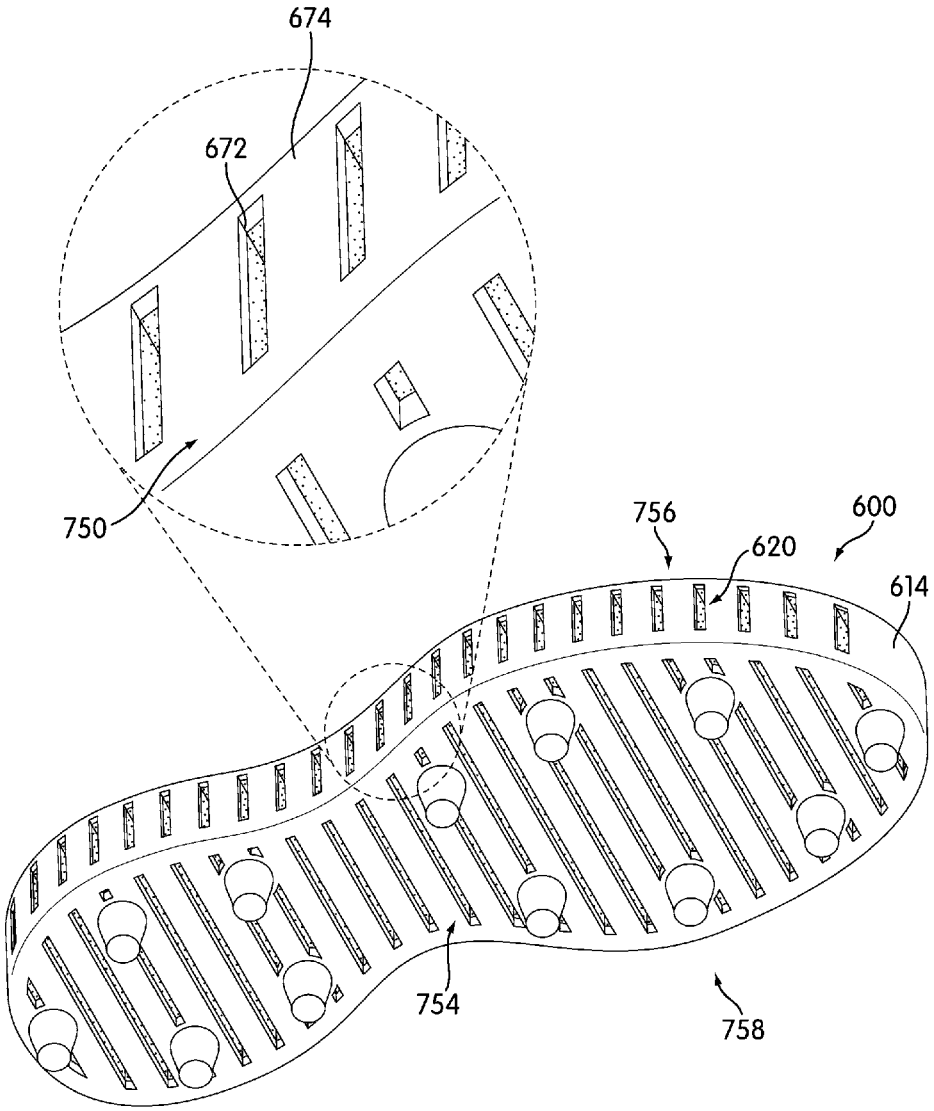
FIG. 10 is an isometric view of an embodiment of an article of footwear with a plurality of slots.

FIGS. 9 and 10 illustrate another embodiment of a sole structure that provides a multi-colored effect. Referring to FIGS. 9 and 10, sole structure 600 comprises midsole 612. In some cases, midsole 612 could be associated with tread assembly 614. The term "tread assembly" refers to a set of rubber projections fixed in place to a thin and flexible matrix lining. In this case, tread assembly 614 may comprise matrix portion 616 and cleat members 618. Matrix portion 616 could be any substantially thin, lightweight and flexible layer. Examples include, but are not limited to: fabric layers, durable film layers, as well as any other thin, lightweight and flexible layer. Examples of tread assemblies, including methods of forming tread assemblies are disclosed in U.S. Ser. No. 11/422,254, filed on Jun. 5, 2006, and U.S. Ser. No. 11/422,258, filed on Jun. 5, 2006, the entirety of both being hereby incorporated by reference.

Sole structure 600 may be provided with plurality of slots 620. In some cases, plurality of slots 620 may be arranged on lateral side portion 656, medial side portion 658 and lower portion 654 of midsole 612. In addition, plurality of slots 620 may also extend through lateral side portion 756 medial side portion 758 and lower portion 754 of tread assembly 614. In particular, outer portions 622 of plurality of slots 620 may be disposed on tread assemblies 614 and inner portions 624 of plurality of slots 620 may be disposed on midsole 612. In some cases, plurality of slots 620 can be arranged on matrix portion 616 so that each slot is spaced apart from cleat members 618.

Sole structure 600 may be provided with a multi-colored effect by using a midsole and a tread assembly of substantially different colors. In the current embodiment, midsole 612 may have first color 672 and tread assembly 614 may have second color 674. In an exemplary embodiment, first color 672 may be substantially different from second color 674.

Referring to FIG. 10, with sole structure 600 in an assembled position, interior surfaces of plurality of slots 620 may be visible on exterior surface 750 of sole structure 600. In this case, sole structure 600 is provided with a multi-colored effect as second color 674 of tread assembly 614 is interrupted by regions of first color 672 at plurality of slots 620. This arrangement provides a multi-colored effect for sole structure 600.

Figure 11:
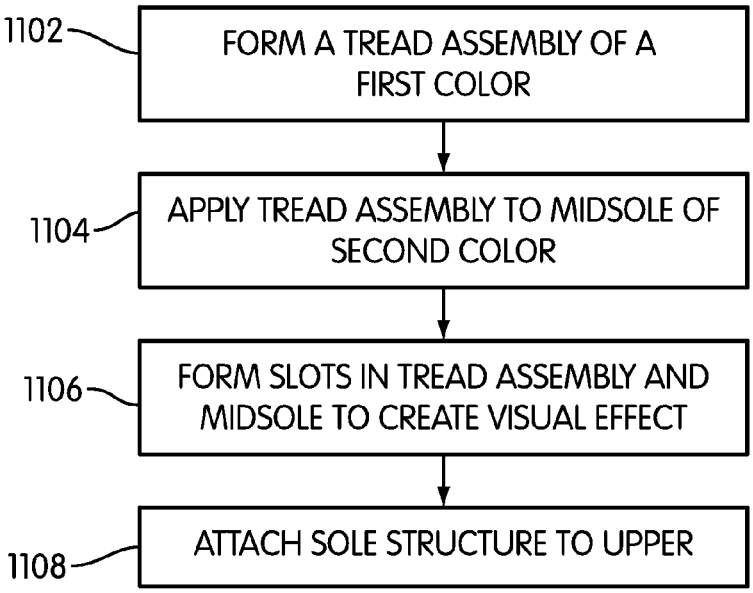
FIG. 11 is an embodiment of a process of making an article of footwear with a plurality of slots.

FIG. 11 illustrates an embodiment of a process for making an article of footwear. In this embodiment, the following steps may be performed by any proprietor configured to manufacture and/or sell an article of footwear. It will be understood that in other embodiments one or more of the following steps may be optional. During step 1102, a tread assembly may be formed having a first color. In particular, a tread assembly may comprise a plurality of cleat members fixedly attached to a matrix layer. The matrix layer may have the first color. Next, during step 1104, the tread assembly may be applied to a midsole having a second color that is different from the first color. The tread assembly can be attached to the midsole in any manner. Following this, during step 1106, slots may be formed in the tread assembly and the midsole to create a visual effect on the sole structure. Generally, any known methods for forming slots in one or more structures can be used. Examples of methods of forming slots are discussed above. Finally, during step 1108, the sole structure may be attached to an upper for make the article of footwear.

In some cases, the slots can be formed in any of the arrangements discussed above. For example, in one embodiment, the slots can be formed in a manner that provides hollowed out portions of a sole structure having substantially x-shaped cross sectional shapes. In particular, slots can be formed through the tread assembly and the midsole that are substantially aligned in the longitudinal direction in the manner discussed in the previous embodiments. In other cases, however, the slots can have any other configuration.

It will be understood that the order of the steps performed above could vary in different embodiments. For example, in another embodiment, the step of forming slots in the midsole and the tread assembly could occur before the step of attaching the tread assembly to the midsole. In other words, the slots could be formed on each component independently and then aligned when the tread assembly is combined with the midsole to form the sole structure.

An article of footwear including slots can be formed in any manner. In some embodiments, a sole structure can be molded in a manner that creates slots in the sloe structure. In other embodiments, slots can be created in a sole structure using any known methods of cutting. For example, in one embodiment, slots can be created using laser cutting techniques. Specifically, in some cases, a laser can be used to remove material from a sole structure in a manner that forms slots in the sole structure. In another embodiment, a hot knife process could be used for forming slots in a sole structure. Examples of methods for forming slots on a sole structure are disclosed in U.S. Patent Application Publication Number 2008/0022553, to McDonald, the entirety of which is hereby incorporated by reference. Other examples of methods that could be used for forming slots are disclosed in U.S. Ser. No. 12/428,501, filed on Apr. 23, 2009, the entirety of which is hereby incorporated by reference. In other embodiments, however, any other type of cutting method can be used for forming slots. Furthermore, in some cases, two or more different techniques can be used for forming slots. As an example, in another embodiment, slots disposed on a side portion of a sole structure can be formed using laser cutting, while slots on a lower portion of the sole structure could be formed during a molding process. Still further, different types of techniques could be used according to the material used for a sole structure. For example, laser cutting may be used in cases where the sole structure is made of a foam material. An example of a method of making a sole structure is disclosed in the slotted sole case.

It will be understood that in different embodiments, slots could be associated with various different portions of a sole structure. In some cases, slots could be associated with a majority of the length of the sole structure. In other cases, slots could be associated with only some portions of a sole structure. For example, in some cases, slots could be disposed on a forefoot portion of a sole structure. In other cases, slots could be disposed on a midfoot portion of an upper. In still other cases, slots could be disposed on a heel portion of a sole structure. Moreover, in some cases, slots could be disposed on a single side of a sole structure, such as the medial or lateral side. In still other cases, slots could be disposed only on a lower portion of a sole structure. In embodiments where slots are only disposed on some portions of a sole structure, the sole structure could include additional provisions for enhancing support and/or comfort. These different provisions could include, but are not limited to airbags, bladders and cushions.

Moreover, in some cases, portions or regions including slots could also include layers of different colors to create visual effects in the manner discussed above. In some cases, these visual effects could be confined to some portions of a sole structure (such as the forefoot, midfoot and/or heel portions as well as the lateral and/or medial side portions). In other cases, these visual effects could extend over a substantial entirety of the sole structure.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of making an article of footwear, comprising the steps of:

forming a cavity in a midsole of a first color;

placing an insert of a second color into the cavity, the insert including an upper surface and an opposite lower surface;

forming a medial slot through the midsole and the insert such that a first upper portion is formed between the medial slot and the upper surface;

forming a lateral slot through the midsole and the insert such that a second upper portion is formed between the lateral slot and the upper surface;

forming a lower slot through the midsole and the insert such that a first lower portion is formed between the lower slot and the lateral slot and a second lower portion is formed between the medial slot and the lower slot;

wherein the first upper portion, the first lower portion, the second upper portion, and the second lower portion all intersect at a central portion;

wherein the first upper portion, the first lower portion, the second upper portion, the second lower portion and the central portion are all positioned at similar longitudinal positions along a longitudinal direction; and wherein the second color is visible through the slots.

2. The method according to claim 1, wherein the step of forming the lateral slot, the medial slot, and the lower slot through the midsole and the insert occurs after the step of placing the insert into the cavity.

3. The method according to claim 1, wherein the step of forming the lateral slot, the medial slot, and the lower slot through the midsole and the insert occurs before the step of placing the insert into the cavity.

4. The method according to claim 3, wherein the step of forming the lateral slot, the medial slot, and the lower slot through the midsole and the insert includes forming a first plurality of slots on the midsole and forming a second plurality of slots on the insert that correspond to the first plurality of slots.

5. The method according to claim 4, wherein a step of aligning the first plurality of slots with the second plurality of slots occurs before the step of placing the insert into the cavity.

6. The method according to claim 1, wherein the step of forming a plurality of slots includes a step of cutting slots into the midsole and insert.

7. The method according to claim 1, wherein the step of forming the lateral slot, the medial slot, and the lower slot includes a step of molding slots into the midsole and molding slots into the insert.

8. The method according to claim 1, further comprising a step of attaching a plurality of cleat members to the midsole.

9. The method according to claim 8, wherein the lateral slot, the medial slot, and the lower slot are spaced apart from one or more cleat members of the midsole.

10. The method according to claim 1, wherein the lateral slot, the medial slot, and the lower slot are formed using a laser cutting technique.

11. The method according to claim 1, wherein the lateral slot, the medial slot, and the lower slot are formed using a hot knife process.

12. A method of making an article of footwear, comprising the steps of:

forming a sole structure comprising:

forming a cavity in a midsole of a first color;

placing an insert of a second color into the cavity, the insert including an upper surface;

forming a lateral slot in the midsole, a medial slot in the midsole, and a lower slot in the midsole;

forming a lateral slot in the insert, a medial slot in the insert, and a lower slot in the insert such that the lateral slot in the insert, the medial slot in the insert, and the lower slot in the insert are all located at similar longitudinal positions along a longitudinal direction and such that an X-shaped portion is formed in the insert between the medial slot in the insert, the lateral slot in the insert and the lower slot in the insert;

whereby when the insert is placed into the cavity, the lateral slot in the midsole is aligned with the lateral slot in the insert;

the medial slot in the midsole is aligned with the medial slot in the insert; and the lower slot in the midsole is aligned with the lower slot in the insert; and attaching an upper to the sole structure.

13. The method according to claim 12, wherein the step of forming the lateral slot in the insert, the medial slot in the insert and the lower slot in the insert, further comprises the step of:

limiting a length of the lateral slot;

limiting a length of the medial slot; and limiting a length of the lower slot;

such that a central portion of the insert remains adjacent to the lateral slot in the insert, the medial slot in the insert, and the lower slot in the insert.

14. The method according to claim 12, further comprising forming the lateral slot in the insert in a triangular shape.

15. The method according to claim 12, wherein the second color of the insert is visible after the step of placing the insert of a second color into the cavity.

16. The method according to claim 12, further comprising attaching a plurality of cleat members to the midsole.

17. The method according to claim 12, wherein the step of forming the lateral slot in the insert, the medial slot in the insert and the lower slot in the insert, further comprises the step of limiting a length of the lateral slot in the insert and limiting a length of the lower slot in the insert such that a connecting portion remains in the insert that separates the lateral slot in the insert from the lower slot in the insert.

* * * * *